US008362379B1

(12) United States Patent
Haas et al.

(10) Patent No.: US 8,362,379 B1
(45) Date of Patent: Jan. 29, 2013

(54) REMOTE SWITCH ACTUATOR

(75) Inventors: Edwin Gerard Haas, Sayville, NY (US); Ronald Beauman, Hicksville, NY (US); Stefan Palo, Jr., East Patchogue, NY (US); Maria Anna Palo, legal representative, East Patchogue, NY (US)

(73) Assignee: U.S. Department of Energy, Washington, DC (US)

( * ) Notice: Subject to any disclaimer, the term of this patent is extended or adjusted under 35 U.S.C. 154(b) by 333 days.

(21) Appl. No.: 12/823,426

(22) Filed: Jun. 25, 2010

(51) Int. Cl.
*H01H 3/02* (2006.01)

(52) U.S. Cl. ..... 200/331; 200/401

(58) Field of Classification Search ..... 200/330–333, 200/400, 401, 500, 501; 335/185–195; 218/7, 218/14, 153, 154
See application file for complete search history.

(56) References Cited

U.S. PATENT DOCUMENTS 4,743,721 A 5/1988 Thuries et al.
6,963,042 B1 * 11/2005 Kouris ..... 200/400
7,820,928 B2 * 10/2010 Simon ..... 200/331

OTHER PUBLICATIONS

Tammy L. Gammon, et al., Incident energy factors and simple 480-v incident energy equations, IEEE Industry Applications Magazine, Jan.-Feb. 2005, pp. 23-3.

* cited by examiner

*Primary Examiner* — Amy Cohen Johnson
*Assistant Examiner* — Marina Fishman
(74) *Attorney, Agent, or Firm* — Joy Alwan; Brian J. Lally; John T. Lucas

(57) ABSTRACT

The invention provides a device and method for actuating electrical switches remotely. The device is removably attached to the switch and is actuated through the transfer of a user's force. The user is able to remain physically removed from the switch site obviating need for protective equipment. The device and method allow rapid, safe actuation of high-voltage or high-current carrying electrical switches or circuit breakers.

16 Claims, 7 Drawing Sheets

REMOTE SWITCH ACTUATOR

The United States Government has rights in this invention pursuant to the employer-employee relationship between the Government and the inventors as U.S. Department of Energy employees at the Brookhaven National Energy Technology Laboratory.

BACKGROUND OF THE INVENTION

1. Field of the Invention

This invention relates to a device and method for activating a switch, and in particular, the invention relates to a removable and adjustable switch actuator for remote activation of a switch handle, or toggle, and a method for remote activation of a switch or toggle.

2. Background of the Invention

Toggling or actuation of electrical switches is common place. However, significant danger is created by the toggling of switches associated with high-current circuits. The danger stems from the sudden breakdown of voltage resistance of the air surrounding the switch. Normally, air is a good insulator, however, the resistivity of air may be overcome if air provides the optimum path to ground and a sufficiently-large electrical current exists.

The passage of electrical current through air creates arcs. Electrical arcs have practical uses, such as in welding, plasma cutting, or as a light source; however not all electrical arcs are desirable. Unintentional electrical arcs formed by high voltage and high current electrical discharges result in particularly dangerous events called arc flashes.

Arc flashes are potentially destructive events releasing large amounts of energy in the form of light and heat. While arc flashes are possible only in some environments (above 480 Volts (V)), the resulting potential injury and risk of damage is unacceptable. For example, industrial equipment such as loading devices commonly use three-phase connections resulting in voltage potential differences of at least 480 volts. If a sufficiently large fault current occurs on such a circuit, the amount of energy released by a resulting arc flash could be catastrophic. Continuing the example, if at 480 Volts, 10,000 Amperes of fault current continues for 10 cycles at 60 Hz, the resulting arc flash would release 0.8 mega joules of energy. By comparison, a hand grenade releases about 0.6 mega joules of energy. While much of the energy released by an arc flash event (radiant energy) is different from a chemical explosion (mechanical shock), both are highly dangerous inasmuch as both produce significant pressure/shock waves that violently propel solid or molten material outward.

The actuation of electrical switches, such as circuit breakers, is especially prone to arc flash events. Upon actuation, the flow of current is interrupted. However, as no switch operates instantly, an ungrounded fault current develops prior to the flow of current ceasing. While it may dissipate harmlessly, arc flashing is also possible resulting in injury to the operator and property damage.

The danger posed by arc flash events has been recognized by worldwide engineering bodies and safety groups. For example, IEEE 1584-2002, Guide for Performing Arc Flash Hazard Calculations, IEEE Industry Applications Magazine, January-February 2005, pages 23-31 provides a method of calculating the level of arc-flash hazard dangers in several scenarios. This industry standard further recommends personal protective equipment (PPE) and specifies a safe working distance. Similarly, the National Fire Protection Association (NFPA) Standard 70-2002 "The National Electrical Code" (NEC) specifies the required warning labels and OSHA Standards 29-CFR, Part 1910 addresses standards for workplaces.

One of the most common means of protecting personnel from arc-flash injury is the use of protective apparel. This apparel can be insulated gloves and full body suits. These suits are aptly named "bee keeper" suits. Due to their insulating capacity, the suits are both uncomfortable to wear and are also expensive. Further, the protective suits require time to don and subsequently remove, even if the switch actuation requires no more than a few seconds. In environments where the ambient temperatures exceed approximately 60° F., these suits cause the wearers to perspire excessively.

The inconvenience of donning bulky protective suits results in their being used less frequently.

A need exists in the art for a method and device for actuating electrical and thermal switches and toggles quickly from safe distances. The method and device should facilitate remote actuation so as to obviate the need for protective apparel. The method and device should adapt to various switch gear configurations and housings. Furthermore, the method and device should electrically and/or thermally insulate the user from arcing or outgassing.

SUMMARY OF THE INVENTION

An object of the invention is to provide a device and method of facilitating actuation of mechanical electrical switches prone to arc flash events which overcomes many of the disadvantages of the prior art.

It is a further object of the present invention to provide the means to facilitate toggling of electrical switches from a safe distance. A feature of the invention is the use of a force tether to actuate a switch. An advantage of the invention is that the device can be employed from a distance beyond a zone of danger posed by electrical and pressure-breaching arc flash events.

An additional object of the present invention is to provide a device for actuation of switches by operators wearing minimal to no protective clothing. A feature of the invention is that an actuation tether employed by the system is electrically and/or thermally insulating. An advantage of the invention is the elimination of time consuming or bothersome protective measures.

A further object of the present invention is to provide a means to actuate switches remotely without permanent alteration to enclosures of switches, valves, or toggles. A feature of the present invention is gripping means removably connected with the enclosures. An advantage of the present invention is that it is adaptable to be received by any type of switch housing configuration or immobile objects in close spatial relationship to the switch.

Another object of the invention is to provide a switch actuation means that increases (e.g. leverages) the force applied by the user, thereby overcoming any internal switch resistance. A feature of the invention is that, in one embodiment, the invention includes a flexible means to provide mechanical advantage to the user in the form of a pulley array. An advantage is that the force applied to the system by the user is increased, thereby allowing the operator to remotely actuate a switch with less force than would be necessary if the operator was actuating the same switch through direct contact. Another advantage is that the flexible means prevents actuation of the subject switch at dangerous proximities to the switch.

Another object of the invention is to provide a means to removably attach a switch actuator to any size or type of power switch. A feature of the invention is the use of an infinitely adjustable gripping means to accommodate a variety of switch panel enclosures. A further feature of the invention is that several different varieties of gripping means frictionally engage the switch housing. An advantage of the invention is that the actuator is adjustable to any number of alternate switch enclosures.

Another object of the invention is to provide a visible indicator of whether the user is too proximate to the switch. A feature of the invention is that the minimum safe distance is denoted on the switch actuator. An advantage of the invention is that the operator can directly determine whether a safe operating distance has been accomplished.

Yet another object of the invention is a method of actuating several electrical switches via one embodiment of the invention. A feature of the invention is the use of more than one switch actuator with a single cross bar. An advantage of the invention is that multiple switches may be controlled using a single bar installation.

Briefly, the invention provides a device for remote switch actuation, the device comprising: at least one adjustable member having a first end having a means for grip-ping, and a second end; a second member having a first open end for containing the second end of the first adjustable member and a second end having a means for grip-ping/mounting; a means for securing and adjusting the first adjustable member within the second member; a platform fixed to the first adjustable member secured within the second member wherein a switch gripping and a switch activating mechanism is mounted on said platform; and a switch gripping and a remote switch activating mechanism.

The invention also provides a method for remote switch manipulation, the method comprising removably positioning a platform in close spatial relationship to the switch; mounting an elongated electrical insulator to the platform such that the electrical insulator is in slidable communication with the platform; encapsulating the switch with a first end of the electrical insulator, such that the switch is electrically and physically isolated from its surroundings; and applying a first force to a second end of the electrical insulator sufficient to remotely actuate the switch.

DESCRIPTION OF THE DRAWINGS

Embodiments of the invention together with the above-stated and other objects and advantages may best be understood from the following detailed description of the embodiments illustrated in the drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
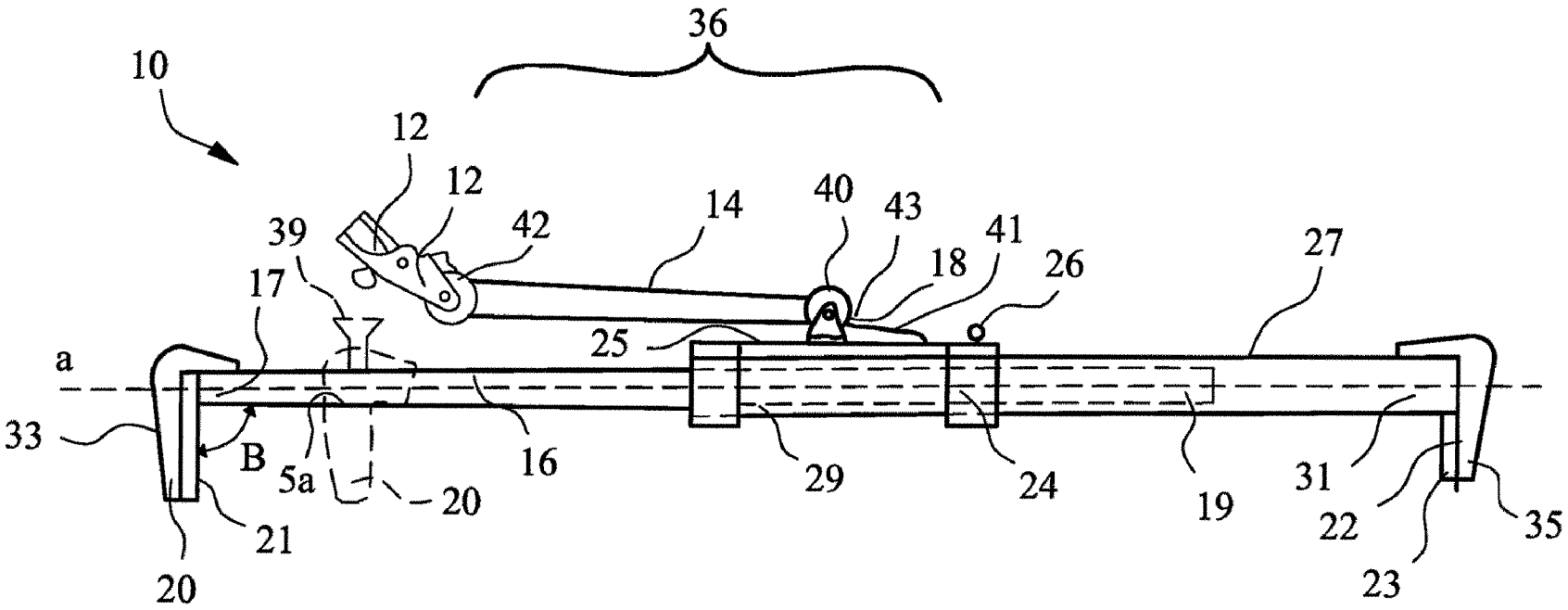
FIG. 1 depicts an elevational view of a device for remote actuation of an electrical switch, in accordance with features of the present invention.

Turning first to FIG. 1, depicted there is an elevational view of one embodiment of the instant invention. The invention comprises a generally elongated device 10 for facilitating remote actuation of switches. The device 10 comprises at least one rigid elongated substrate such as an adjustable bar 16 having a first end 17 and a second end 19. In one embodiment, the adjustable bar comprises an adjustable rail or a telescoping member. In a preferred embodiment, the device 10 comprises two adjustable bars, each bar having a first end and a second end. Each bar may be made from any suitable material, such as a conductive metal; however, in some embodiments of the invention, the adjustable bar 16 comprises an electrically insulating material. The adjustable bar 16 must be sufficiently rigid to form a base for the remaining components of the device 10.

In axial alignment with the bar 16 is a sleeve 27 adapted to slidably receive the second end 19 of the bar 16. The sleeve defines a first end 29 and a second end 31. In extending beyond the length of the bar 16, the sleeve 27 also defines the telescoping member.

Mounted intermediate to the first end 29 and second end 31 of the sleeve 27 is a means 26 for reversibly fastening the bar 16 to the sleeve 27. This fastening means 26 facilitates fastening of the sleeve 27 to infinite points along longitudinally-extending portions of the bar 16. The fastening means 26 threadably communicates with a transverse aperture of the sleeve so as to frictionally engage with an opposing surface of the bar 16.

Switch Housing

Engagement Detail

Located at the first end 17 of the adjustable bar 16 is a first gripping means 20. The second end 31 of the sleeve 27 terminates in a second gripping means 22. In one embodiment of the invention, the gripping means 20, 22 comprise a hook assembly. The hook assembly engages protruding sides of a switch housing (not shown). Other gripping means may include hook-and pile configurations, a vise-like assembly, gripping based on friction surface tension, and/or temporary adhesive.

The gripping means 20, 22 are intended to mount the telescoping member to a switch enclosure. Inasmuch as different types of switch enclosures are in use, different gripping or mounting means 20, 22 are used. For example, as shown in FIG. 1, the gripping means 20 comprises an angled substrate such that one end of the substrate extends at an angle β from the longitudinal axis a of the adjustable bar 16. FIG. 1 shows the one end of the angled substrate extending substantially orthogonal to the longitudinal axis α. Optionally, the angled substrate defines fluted surfaces or other friction enhancing means at the enclosure contact regions 21, 23, 33 and 35. Safety enhancements may further include the angled substrate comprising electrically insulating material such as, but not limited to rubber, wood, polymer, and combinations thereof.

In other embodiments, the gripping means includes a hook assembly designed to be received by a corresponding mounting point on a wall or other structure surrounding the switch. Furthermore, certain switch enclosures feature slots where the gripping means 20, 22 can be removably received. In an alternative embodiment, the switch enclosure is mounted in a depression within a wall or is surrounded by a housing which extends beyond the plane formed by the face of the switch. In such embodiments, the gripping means 20, 22 would not impart inward or medial force against the outside of the enclosure, but rather lateral pressure or outwardly directed force against on the inside of the enclosure sufficient to maintain the telescoping bar in place.

Switch enclosures often contain banks of switches and several empty positions reserved for future expansion of the electrical service. Embodiments of switch enclosure gripping means 20, 22 are envisioned to removably engage the switch enclosure whereby the gripping mean define cross sections complementary to the cross sections of the aforementioned empty switch box positions. This adapts the gripping means to be received by one or a plurality of unoccupied breaker cavities, receptacles or other apertures found on the faces of typical switch enclosures. In this embodiment, the gripping means 20, 22 engage with or otherwise anchor to the face of switch enclosures at points medially disposed from the edges of the switch enclosures. As such, these cross section-compatible gripping means are disposed at the ends of the rigid elongated substrates comprising the telescoping bar 16 and mating sleeve 27, and/or intermediate the ends of these rigid substrates.

In one embodiment, the gripping means 20, 22 are removably attached to the telescoping member thereby allowing the removal and replacement of the gripping means as desired.

The adjustable bar 16 including gripping means 20, 22 features parallel and oppositely directed clamping surfaces 21, 23, designated herein as a first clamping surface 21 and a second clamping surface 23. These first 21 and second 23 clamping surfaces face inwardly toward each other and the center of the device. The first clamping surface 21 is movable with respect to the rest of the device, while the second clamping surface 23 remains fixed.

Optionally, the gripping means 20, 22 are removably attached to the side of the switch enclosure using temporary attachment means. In other embodiments, the gripping means, or a complementary surface of a portion of the gripping means, is permanently coupled with the switch enclosure.

The device's length is selected to match a range of switch enclosure physical dimensions, so as to facilitate secure installation of the adjustable bar 16. In one embodiment, where the switch enclosure protrudes beyond the surrounding wall, the length of the device 10 is adjusted so that its clamping surfaces 21, 23 removably engage the sides of the switch enclosure via medially-directed, or inwardly directed, force, thereby locking the adjustable bar in place over the front face of the switch panel.

When installing the device 10 on switch enclosures which do not extend beyond the plane formed by the wall, the bar 16 is positioned within the confines of the enclosure and extended axially, i.e., outwardly from the sleeve 27, to provide the device 10 with significant breadth to engage other immobile physical features of the enclosure or the surrounding wall. For example, if the switch enclosure surroundings include wall receptacles, the device 10 is extended so that an outwardly facing surface 33 of the first gripping means 20 and an outwardly directed facing surface 35 of the second gripping means 22 are in physical proximity to engage the receptacles.

In light of the foregoing, it should be appreciated that each of the gripping means 20, 22 defines a plurality of surfaces for engaging switch enclosures via laterally directed force, medially directed force, or a combination of medially-directed and laterally-directed force. It should be further appreciated that the gripping means 20 may itself be in slidable communication with its support rod 16, and fastened in place at infinite positions along the rod via a wing nut 39 or some other friction engaging means. In this instance, a region of the gripping means 20 defines a transverse channel 50 or aperture to allow passage of the support rod 16 completely through the region of the gripping means that lies coaxially with the support rod. As shown, the wingnut 39, threadably received by the coaxially aligned region of the gripping means 20, extends into the channel at an angle substantially perpendicular to the axis of the channel, to contact the support rod 16. FIG. 1 shows such a slidable gripping means in phantom.

Optionally, in those situations involving switch enclosures that do not extend beyond the plane formed by the wall, the invention further comprises mounting points that may be added to the wall or to the switch enclosure. The mounting points are designed to securely fasten the device to the wall while allowing for rapid connection of the gripping means 20, 22 of the device 10. In an embodiment, the mounting points include brackets, blocks, recesses, a protrusion or boss, or other mounting means.

Bar Extension

Detail

FIG. 1 depicts the adjustable bar 16 in telescoping communication with the sleeve 27 to facilitate length extensions. An axially extending platform 25 communicates with longitudinally extending groves in the bar 16 or sleeve 27 via a tongue/groove configuration. In other embodiments, the platform 25 is connected to, otherwise communicates with the bar 16 or sleeve 27 via a second sleeve mechanism, which is integral to the platform 25, and adapted to slidably communicate with either the bar 16 or sleeve 27. The fastener adjustment mechanism 26 allows the platform 25 to move along the longitudinal axis of the bar 16. In one embodiment, the fastener adjustment mechanism 26 comprises a thumb screw in threadable communication with a region of the second sleeve defining a transverse threaded aperture. The screw extending through the aperture, contacts the bar or the first sleeve and locks same into a particular position relative to the bar 16 or the first sleeve 27.

The adjustable bar may comprise a pneumatic adjustment means allowing the bar to match the dimensions of opposing interior surfaces of the enclosure, which houses the power switch to be remotely operated. Such pneumatic means provides infinite horizontal or vertical positioning adjustment of a means 12 for capturing a switch, as described herein, and secures positioning of the device by applying laterally-directed, or outwardly directed force to the opposing interior surfaces.

Activation Substrate

Detail

The platform 25 is provided for mounting a switch-gripper and switch-activating mechanism 36, the platform attached to the first end 29 of the sleeve 27. The mechanism 36 comprises a first pulley 40 in rotatable communication with the platform 25. A second pulley 42 communicates with the first pulley 40 (and therefore the platform) via a cord, rope, cable tether, or suitable flexible elongated substrate 14. A first end 41 of the flexible elongated substrate 14 is anchored to the platform 25 and in close spatial relationship to the first pulley 40. A second end 43 of the flexible elongated substrate 14 is free-hanging from the first pulley 40.

In one embodiment of the invention (FIG. 2A), the elongated substrate 14 is a composite structure comprising a core fiber 13 and a sheath 15. A proximal end of the core fiber 13 is terminated in a plurality of opposing substrates 28 to define an opening 21. The opening is adapted to receive a switch protrusion 23, in situations where the switch protrudes from the face plate 111 of a switch box (see also FIG. 3). Given the polymeric construction of the core fiber, the proximal end is engineered such that the opposing substrates 28 are normally spring biased in a lateral direction, as depicted in FIG. 2B.

The sheath 15 is adapted to slide over the core fiber 13 such that any annular space 17 between an outside surface of the fiber 13 and an inside surface of the sheath is at a minimum. This minimal clearance will facilitate closure of the opening 21 about the switch protrusion when the sheath is slid in a proximal direction toward the protrusion. Specifically, as the sheath is pushed toward the proximal end of the fiber 13, the leading edge of the sheath imparts medially directed force on the outside surfaces of each of the opposing substrates. When the sheath is positioned at its most proximal point, the opposing substrates are in close spatial relationship to each other so as to form a cavity having a cross section complementary to the cross section of the switch protrusion.

Users of the device first engage the switch protuberance with the core fiber 13 by positioning the fiber such that the switch is surrounded by the opposing substrates. Then, the sheath 14 is slid over the substrates so as to cause the substrates to encapsulate and otherwise capture the switch.

The length of the sheath is determined to provide a safe distance between the switch and a user of the invented device. If the user pulls on the sheath 15 instead of a distal end of the fiber protruding from a distal end of the sheath, the sheath slides distally, without imparting a force on the switch. As such, the position of the sheath at its proximal-most position, as shown in FIG. 2A physically and electrically isolates the switch from the user and adjacent structures while simultaneously preventing the user from directly manipulating the switch.

Only when the user positions the sheath between herself and the switch is safety actuated. In that configuration, a safe distance for manipulation via the core fiber, is evident upon respective indicia on the outside surface of the core fiber, as designated by the arrows.

Figure 2A:
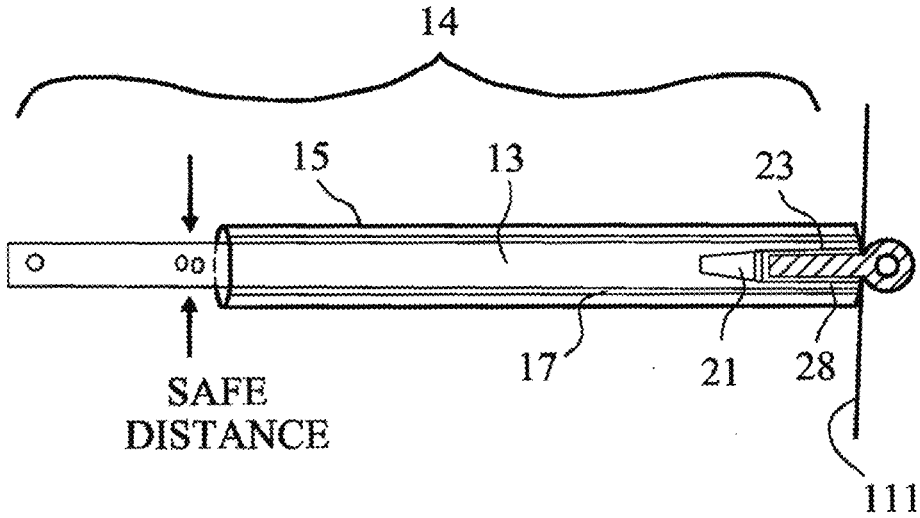
FIGS. 2A-B depict a detail view of a proximal end of a heterogeneously constructed, elongated electrical insulator used to manipulate the switch, in accordance with features of the present invention.
Figure 2B:
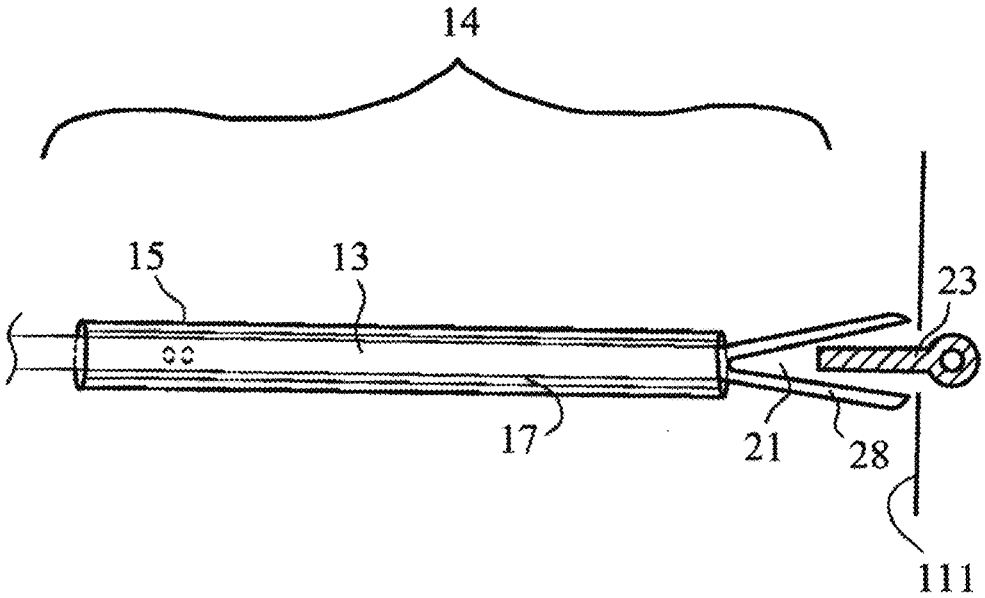

The tether configuration shown in FIGS. 2A-B can be utilized with a single pulley configuration such that the proximal end of the composite fiber 14 threads through a first pulley 40 to engage the switch. The distal end of the composite fiber is pulled by the user of the device.

Figure 2C:
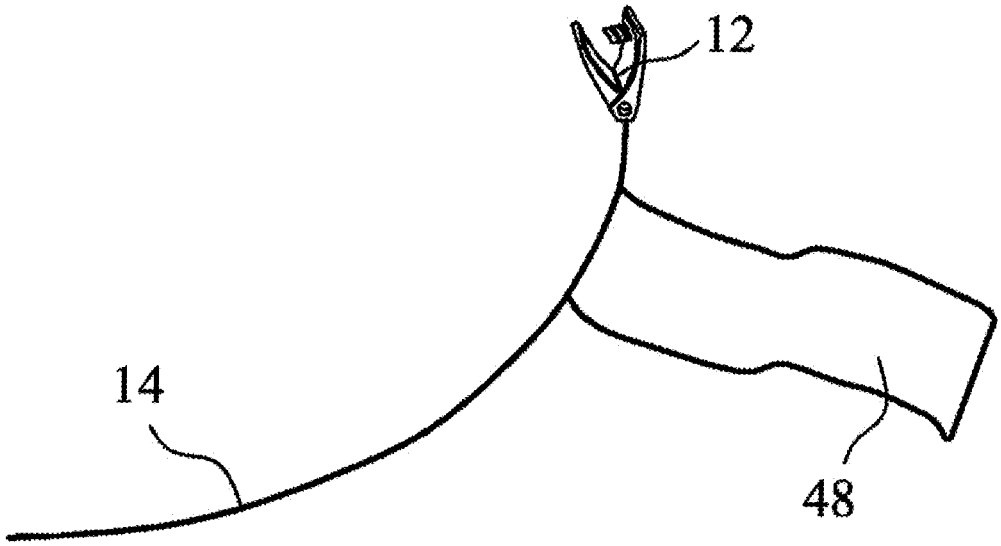
FIG. 2C depicts an alternative switch captive means, in accordance with one embodiment of the present invention.
Figure 2D:
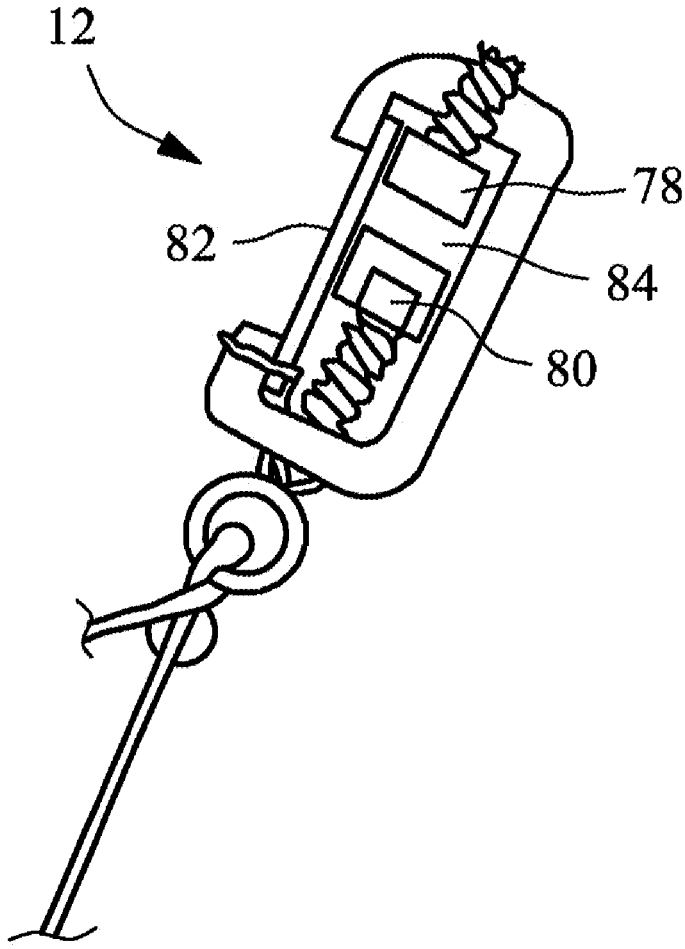
FIG. 2D depicts another alternative switch captive means, in accordance with features of the present invention.
Figure 4:
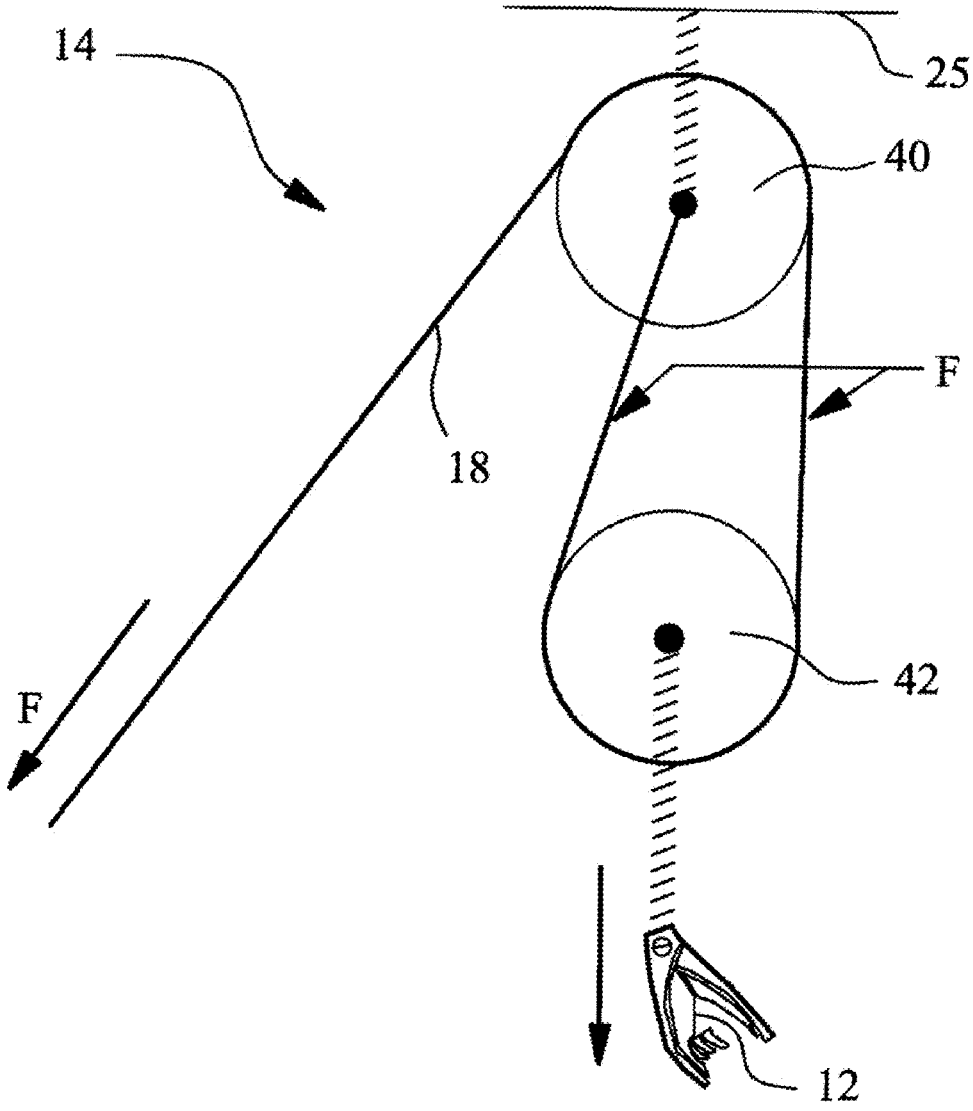
FIG. 4 depicts a detailed schematic view of the mechanical advantage means provided by one embodiment of the invention in accordance with features of the present invention.
Figure 5:
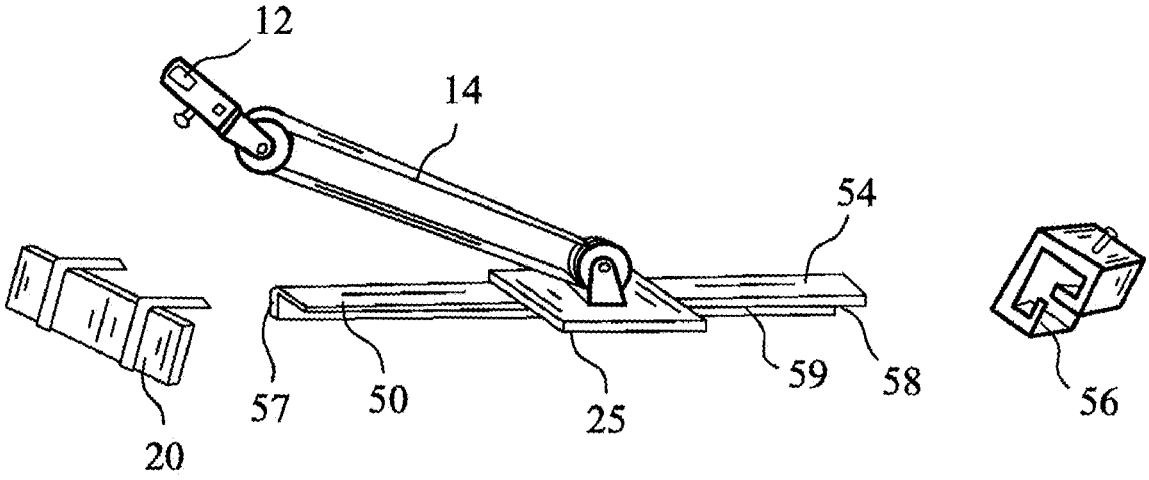
FIG. 5 depicts a partially exploded view of another embodiment of the invention in accordance with features of the present invention.

Tether arrangements depicted in FIGS. 2C-D are preferably utilized a two pulley configuration as shown in FIGS. 1, 4 and 5. FIG. 2*c* depicts a first region 46 of the elongated substrate 14 colored red. A safe operating distance is reached only once the first region is fully extended away from the switch. Optionally (FIG. 1), a protective sheath can be placed over the distal region of the tether, 18 and distally positioned so that it is between the first pulley 40 and the distal end of the tether 18. This way, if a user attempts to pull the tether 18 through the sheath, the sheath simply slides distally without actuating the switch. Only when the sheath is positioned forward of proximal of the tether is the safety indicia visible on the tether.

A sheath need not be utilized in the tether configuration shown in FIG. 2C. Rather, the elongated substrate 14 incorporates one or more safety labels 48. The safety label 48 includes actuation distances for different voltage potentials. The operator is able to move sufficiently away from the switch by referencing the safety label 48. Inasmuch as the safety label is integrated into the elongated substrate 14, the information contained thereon is always available to the operator.

Positioned in close spatial relationship to the second pulley 42 is the means 12 for engaging a switch component, said means comprising a clip, a cord, a clamp, or some other rigid or flexible grabbing mechanism. In one embodiment, this captive means defines an enclosure or shell, the interior of which clamps or otherwise engages the switch. This configuration prevents direct contact of the switch by the user's hand, such that actuation of the switch occurs only through a pulling force applied to the flexible elongated substrate. In one embodiment, the switch captive means 12 comprises a handle designed to removably connect with the switch to be actuated.

As noted supra, a proximal end of the tether terminates in a switch cover shell. The shell engages the switch to anchor the tether to the switch. Due to the shell's cover and interaction with the switch, a user cannot directly impart torque to the switch so as to activate it. In one embodiment, the shell envelopes the switch in a flexible cocoon and is in rotatable communication with the switch. As force is applied to the tether, the switch covering shell is made taut and, and the switch is actuated.

The combination of the second pulley 42 and the switch captive means 12 may be encapsulated by a flexible sleeve. The flexible sleeve is pre-marked so as to be extended to a minimal safe distance. The extended sleeve ensures that the switch is only actuated from the safe distance.

Another switch captive means 12, shown in FIG. 2D, comprises a first adjustment screw 78 and a second opposing adjustment screw 80 coaxially aligned with the first screw. The substantially flat opposing surfaces of the adjustment screws 78, 80 form a switch receipt aperture 84. During installation of the switch captive means 12, at least one adjustment screw 78 or 80 is opened so as to accommodate a protruding switch handle or nub within the aperture 84. Upon positioning the switch nub within the aperture 84, at least one adjustment screw 78, 80 is closed so as to narrow the aperture 84 and frictionally fix the switch within its aperture 84. In at least one embodiment, the switch captive means 12 includes a plate 82 designed to close the switch aperture 84 from an additional side. The plate 82 prevents direct access to the switch once the captive means 12 are installed and further assists in the installation of the captive means 12 on the switch by closing-off one side of the aperture 84.

The flexible substrate 18, such as the tethers shown in FIGS. 2A-D, allows operators of the actuator to remotely operate the switch handle captured by the switch gripping means 12. In one embodiment, a two-step method is necessary for switch actuation.

The tether 18 must be of a length sufficient to first force the user to move beyond a zone of danger stemming from a possible arc flash-, thermal-, or pressure-breaching event at the switch site. (For example, in one embodiment, the user force tether 18 is of a length sufficient to allow the device operator to stand behind a shielding wall.) In the case of the configuration depicted in FIGS. 2A-B, this length is determined by first positioning a protective sheath 15 over the tether and sliding the sheath toward the switch until the proximal end of the sheath encapsulates the switch. Upon so positioning the sheath, distal regions of the core fiber 13 is exposed, and along with the distal regions, indicia of where the user should hold the core fiber depending on the energy or pressure associated with the switch gear.

Second, once the sheath is positioned, and the core fiber is extending through the sheath with substantially no slack, axial force is imposed on the core fiber 13 and in a distal direction, for a time, and in sufficient amount to actuate the switch. Thus, in this embodiment of the device, the switch can only be actuated when the core fiber is first positioned within the sheath and then drawn tight by the user. As noted supra, written indicia or other visible markings exist along the tether to indicate safe grabbing distances to the user, depending on current levels. The tether 18 is generally comprised of an insulating material, for example nylon.

The switch activating mechanism 36 moves in any direction in reference to the bar 16. The switch activating mechanism 36 is shown as substantially parallel to the bar 16. The only limit on the distance between the switch activating mechanism 36 and the mechanical advantage holder 24 is the distance between the pulleys as dictated by the length of the tether 18.

As shown in FIG. 1, the device 10 comprises a single switch activation mechanism 36 attached to the bar 16. As such, the device comprises at least one switch capture means. In other embodiments, not shown, a plurality of switch activation mechanisms similarly mounted are envisioned.

In regards to selecting materials for the components of the invention, the primary consideration is that the materials be low cost and of light weight. Further, in order to not propagate the electrical danger of an arc flash event, the materials are either electrically and thermally insulating, or are finished with an insulating coating, or have a layer of insulating material where needed.

Figure 3:
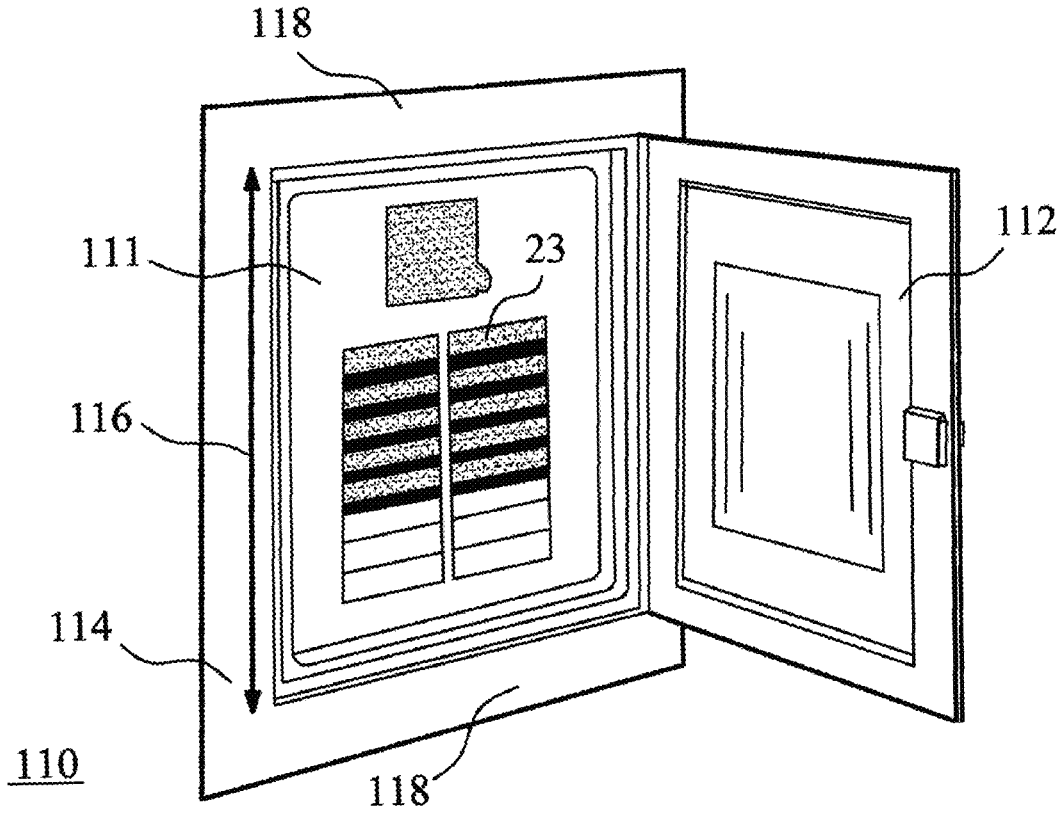
FIG. 3 depicts a wall-mounted switch enclosure capable of receiving at least one embodiment of the invention.

A wall and switch enclosure are depicted in FIG. 3. The switch enclosure 114 is permanently affixed to the wall surface 110. For the enclosure 114 depicted in FIG. 3, the gripping means must also accommodate the panel access door 112. The panel access door 112 must be open to actuate switches contained by the enclosure 114; however, the panel access door 112 inhibits mounting of the device. Generally, higher-voltage motor-control centers do not have access panels and are fully accessible. However, lower voltage/amperage panels often include panel access doors 112. When installing on such enclosures 114, the gripping means 20, 22 are extensible over the first dimension 116 of the enclosure 114. In one embodiment, the grippers engage the regions proximal 118 to the ends of the first dimension 116 of the enclosure 144. Mounting points may be added to the proximal regions 118.

FIG. 4 schematically depicts the switch activation mechanism 36. The mechanism comprises the two interconnected pulleys 40, 42. The first pulley 40 is fixed to the fastening platform 25. The platform 25 is substantially a flat surface for attaching first pulley 40 to the platform 25. However, as can be appreciated from the above description, the platform 25 includes a number of features to enable it to removably connect with the adjustable bar 16 or the sleeve 27.

The flexible elongated substrate 14, such as a tether, engages, enmeshes with or otherwise communicates with the first pulley 40, by being routed between the pulley 40 and the platform 25. The tether 14 continues and is threaded through a second pulley 42, the second pulley being closest to the switch engaging mechanism 12 than the first pulley. The tether 14 only frictionally engages the second pulley 42, but has its first end 4 fixed to the first pulley 40 or to the platform onto which is mounted the first pulley. The switch activating mechanism 32 is connected to, or in registration with, the second pulley 42.

A pulling force F, applied to the free end of the tether, is translated along the first pulley 40 towards the second pulley. The switch activator 12 attached to the second pulley 42 is able to overcome an opposing force F2, as long as the initial pulling force F is at least greater than half the strength of the opposing force F2.

The activating mechanism 32 provides simplicity of design and low requirements to train staff. The use of mechanical components ensures that operators will be able to diagnose any malfunction and correct problems, such as misrouting of the tether 14. Further, by using a pulley-based mechanical advantage system, switch actuation can take place remotely without the use of a power supply at the switch. However, in other embodiments, different mechanical advantage means are employed including pneumatic force transfers. Finally, in an electronic embodiment of the invention, the switch activator 12 is moved by an electrical solenoid. In such embodiments, the user exerts minimal force on a hardwired or wireless control in order to toggle a switch.

FIG. 5 depicts another embodiment of the invention. In place of an adjustable bar 16, FIG. 5 shows use of a first rail 50 in slidable communication with a second rail 54. The platform 25 is affixed to a first surface 58 of second rail 54 so as to allow for the removable positioning of the platform 25 along longitudinally extending regions of the first rail 50. In one embodiment, two sets of parallel rails (depicted as 90 degree equal-leg metal angles, with only one set of rails shown in FIG. 5) are mounted so that one rail 50 may slide inside the outer rail 54. A rail locking device 56 is used to lock the second or outer rail 54 to the first or inner rail 50. The distal ends 57, 58 of the rails terminate in a gripping means 20. The outer rail is also connected to a corresponding gripping means, not shown.

The rail device 56 is designed to lock the outer rail 54 in place through the application of frictional force on the first surface 58 of the outer rail 54 and the second surface 59 of the outer rail 54.

To operate the device, an operator first positions the adjustable bar 16 in close proximity to the target switch, and preferably over the face of an open switch box such that the device spans substantially the entire breadth of the switch box. The device 10 is attached to the switch housing or adjacent structures using the gripping means 20. Once the device 10 is anchored, the switch captive means 12 is mated with the target switch.

Upon taking a safe position, the switch operator applies force to the tether 14 by, for instance, pulling at the extreme end (or at a pre-marked safe location) of the tether 14. The force is then transferred to the switch captive means 12, which in turn actuates the switch. If an arc flash or pressure breach event occurs during activation, it does not harm the operator, who is sufficiently distant from the event.

In other configurations, not shown, more than one platform 25 is used in conjunction with the cross bar 16. For example, opposing switch captive means 12 are used in one embodiment to allow the toggling of a switch handle in either direction. Other embodiments are directed to actuation of switches with high physical resistance, which may require more than one activator. In some embodiments, the invention further comprises pulley sheaves designed to increase the mechanical advance of the tether 14. The number of switch captive means 12 is dictated by the length of the adjustable bar 16 and additional switch captive means 12 are installed as needed on a single bar 16. Further, in those implementations of the invention designed for actuation of several switches, the platform 25 is elongated so as to accommodate multiple actuation means.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The embodiment of the invention in which an exclusive property or privilege is claimed is defined as follows:

1. A device for remote switch manipulation, the device comprising:

a) at least one adjustable member having a first end and a second end, the first end terminating in a first means for gripping;

b) a second member having a first open end adapted to receive the second end of the first adjustable member and a second end terminating in a second means for gripping;

c) a means for securing and adjusting the second end of the first adjustable member within the open end of the second member;

d) a platform fixed to the second member; and e) a switch-capturing mechanism, an intermediate advantage mechanism comprising at least two pulleys and a remote switch-activating mechanism comprising a flexible elongated substrate, wherein said mechanisms rotatably communicate with said platform.

2. The device as recited in claim 1 wherein the switch capturing mechanism, once mounted onto the switch, prevents direct contact of the switch by the user.

3. The device as recited in claim 1, wherein the at least one adjustable member further comprises a telescoping member wherein said telescoping member is infinitely adjustable along the length of the member.

4. The device as recited in claim 1 wherein the flexible substrate comprises a core fiber substantially encapsulated by, and in slidable communication with, a sheath.

5. The device as recited in claim 1 wherein said switch capturing mechanism reversibly attaches to the switch via friction, or snap-fit configuration or hook-and-pile configuration.

6. The device as recited in claim 1 wherein said first and second means for gripping each defines friction-engaging surfaces.

7. The device as recited in claim 6 wherein said friction engaging surfaces are oppositely faced.

8. The device as recited in claim 1 wherein each of the gripping means define engaging surfaces in opposite directions.

9. The device as recited in claim 1 wherein the gripping means comprises a mechanical clip to removably attach to the switch.

10. The device as recited in claim 1 wherein said secure combination of the first adjustable member within the second member supports at least two mechanical advantage means and corresponding switch gripping means wherein a first switch gripping means applies force to the switch in a first direction and a second switch gripping means applies force to the switch in a second direction.

11. A method for remotely manipulating a switch, the method comprising:

a) removably positioning a platform in close spatial relationship to the switch;

b) mounting an elongated electrical insulator to the platform such that the electrical insulator is in slidable communication with the platform;

c) encapsulating the switch with a first substrate of the electrical insulator in direct contact with the switch and a second substrate overlaying the first substrate, such that the switch is electrically and physically isolated from its surrounding; and d) applying a force to the electrical insulator in two discrete steps sufficient to remotely actuate the switch.

12. The method as recited in claim 11 wherein the step of applying the force comprises:

a) supplying a tether comprising a core fiber in slidable communication with a sheath;

b) positioning a proximal end of the fiber around the periphery of the switch;

c) sliding the sheath over the proximal end of the core fiber to cause the fiber to fasten to the switch; and d) applying a torque to a distal end of the fiber.

13. The method as recited in claim 12 wherein applying a first force to the tether requires the user to take up a distance from the switch, and then applying a force to the tether to manipulate the switch.

14. The method as recited in claim 11 wherein the switch is actuated solely via force applied to the flexible substrate when the gripping means is coupled to the switch.

15. The method as recited in claim 11 wherein the platform is adjustable to fasten to a switch housing.

16. The method as recited in claim 11 further comprising a mechanical advantage means and a second switch gripping means and a second activator are removably connected to the same switch; and applying force to the switch in a first direction using the first activator and applying force in a second direction using the second activator.

* * * * *